US007946427B2

(12) United States Patent
Lilie et al.

(10) Patent No.: US 7,946,427 B2
(45) Date of Patent: May 24, 2011

(54) SCREEN ASSEMBLIES UTILIZING SCREEN ELEMENTS RETAINED IN PERFORATED TROUGHS

(76) Inventors: Glenn T. Lilie, Pearland, TX (US); Michael R. Morgenthaler, Houston, TX (US)

( * ) Notice: Subject to any disclaimer, the term of this patent is extended or adjusted under 35 U.S.C. 154(b) by 0 days.

(21) Appl. No.: 12/214,381

(22) Filed: Jun. 18, 2008

(65) Prior Publication Data

US 2008/0251432 A1 Oct. 16, 2008

Related U.S. Application Data

(63) Continuation of application No. 10/922,342, filed on Aug. 20, 2004, now abandoned.

(51) Int. Cl.
*B07B 1/46* (2006.01)

(52) U.S. Cl. ..... 209/399; 209/403

(58) Field of Classification Search ..... 209/397, 209/399, 400, 403, 405
See application file for complete search history.

(56) References Cited

U.S. PATENT DOCUMENTS

| | | | | |
|---|---|---|---|---|
| 1,098,979 | A * | 6/1914 | Schuchard | 209/457 |
| 1,989,777 | A * | 2/1935 | Wettlaufer | 209/17 |
| 5,551,575 | A * | 9/1996 | Leone | 209/273 |
| 5,598,930 | A * | 2/1997 | Leone et al. | 209/403 |
| 5,690,826 | A * | 11/1997 | Cravello | 210/384 |
| 5,720,881 | A * | 2/1998 | Derrick et al. | 210/388 |
| 6,000,556 | A * | 12/1999 | Bakula | 210/388 |
| 6,669,027 | B1 * | 12/2003 | Mooney et al. | 209/405 |
| 2008/0093268 | A1 * | 4/2008 | Hukki et al. | 209/399 |

* cited by examiner

*Primary Examiner* — Joseph C Rodriguez
(74) *Attorney, Agent, or Firm* — Strasburger & Pride, LLP

(57) ABSTRACT

A screen assembly is disclosed for use with vibratory separators. The screen assembly includes a structural frame mounted to a vibratory separator into which a plurality of lightweight and flexible screen elements are inserted into multiple rows of perforated troughs which have geometric shapes. The perforated troughs are bonded to each other and to the structural frame. The perforated troughs are aligned parallel to the direction in which solids are conveyed by a vibratory motion.

20 Claims, 7 Drawing Sheets

Alternative Screen Element Retention and Extraction Method

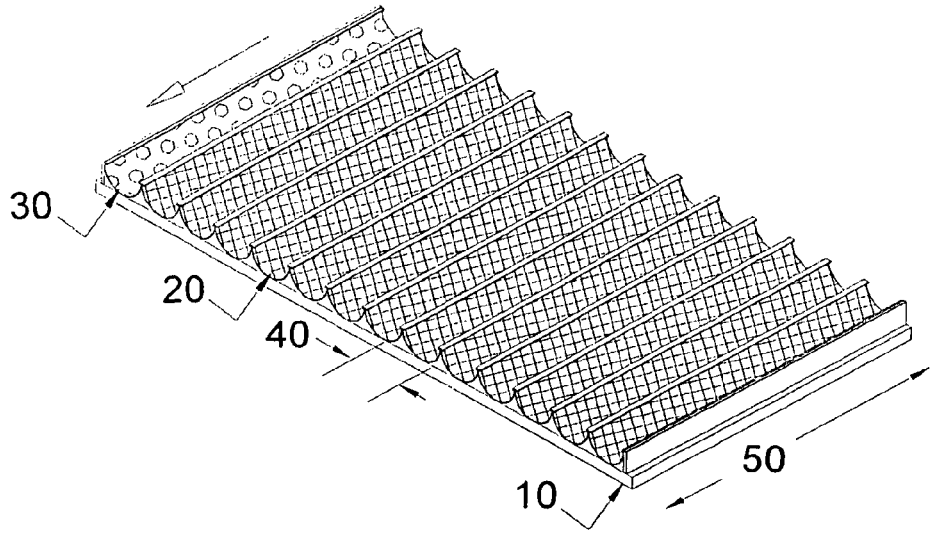
Figure 1: Screen Assembly with Troughs for Separators that accept Panel Style Screens
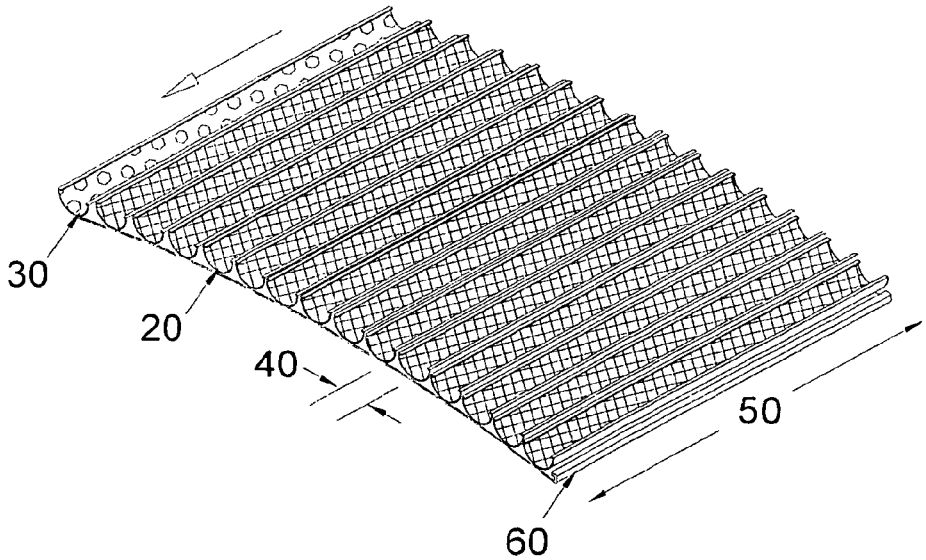
Figure 2: Screen Assembly with Troughs for Separators that accept Hookstrip Style Screens

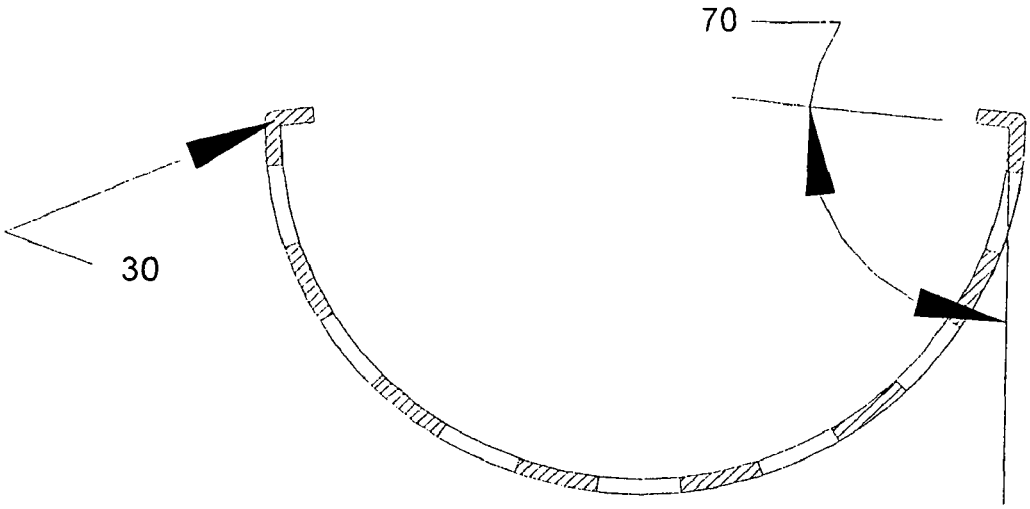
Figure 3: Cross Section 3-3 of Perforated Trough shown in Figure 11
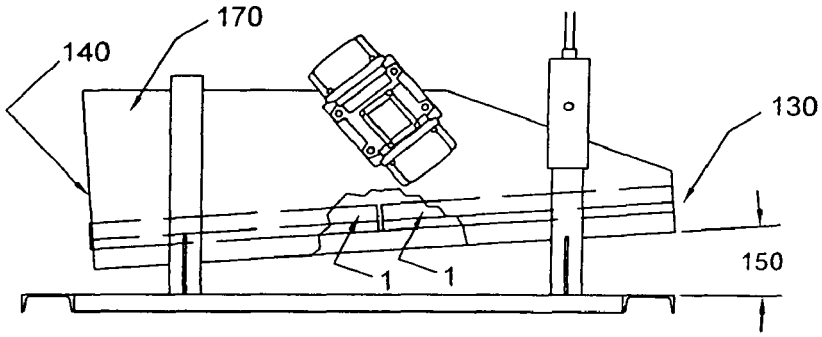
Figure 4A: Side View of Separator with Screen Assemblies Installed
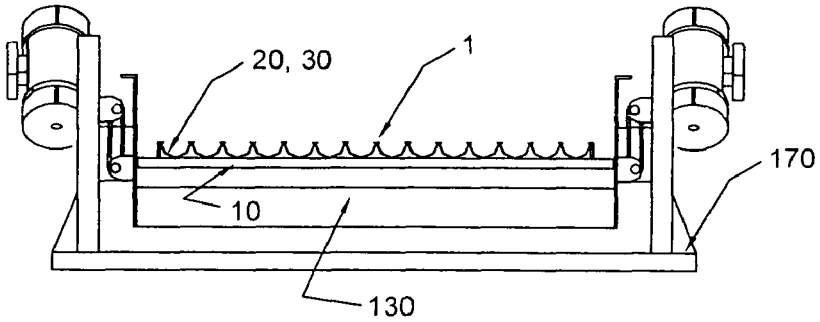
Figure 4B: Discharge End View of Separator with Screen Assemblies Installed

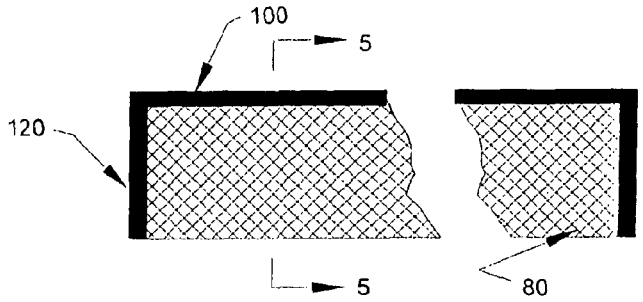
Figure 5A: Side View of Non-Pleated Screen Element
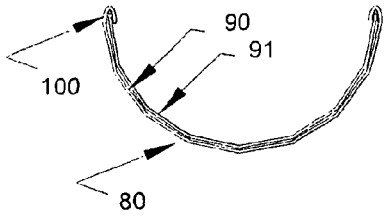
Figure 5B: Cross Section 5-5
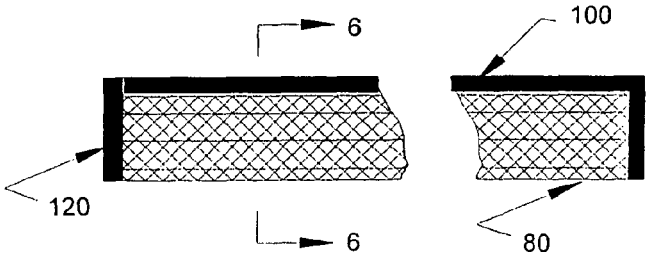
Figure 6A: Side View of Pleated Screen Element
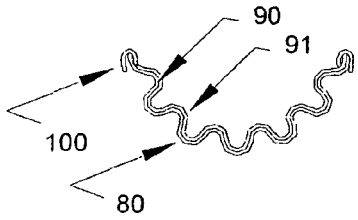
Figure 6B: Cross Section 6-6
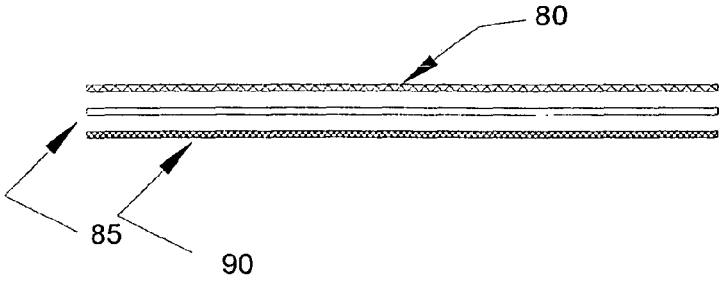
Figure 7A: Screen Media Assembly for Formed Screen Elements

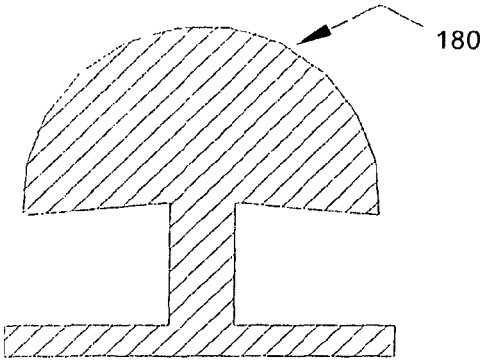
Figure 7B: Cross Section of the Male Press used to Form Screen Elements
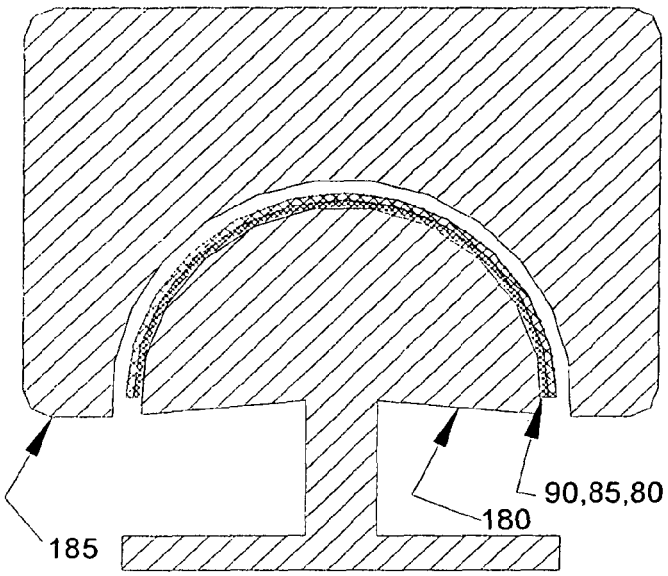
Figure 7C: Cross Section of Male and Female Components used to Form Screen Elements
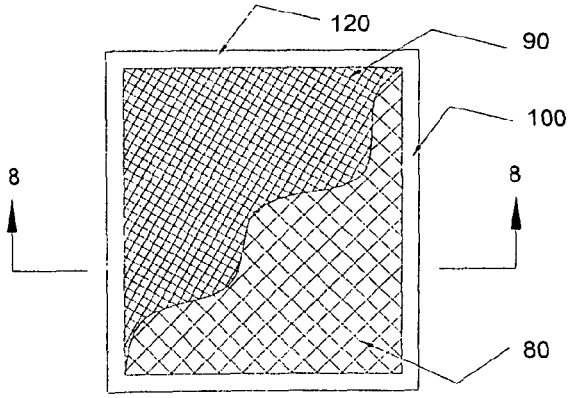
Figure 8A: Top View of Non-Pleated Flat Element
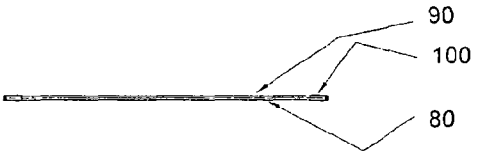
Figure 8B: Cross Section 8-8

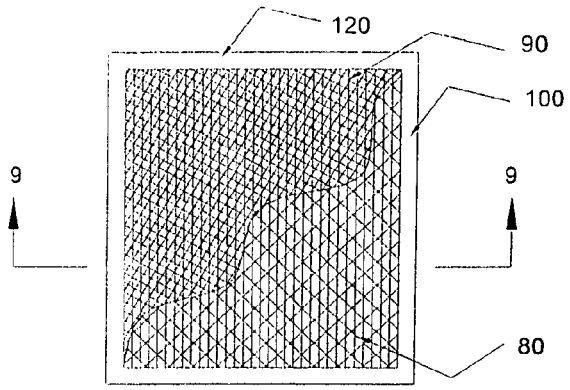
Figure 9A: Top View of Pleated Flat Element
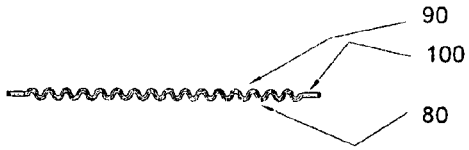
Figure 9B: Cross Section 9-9
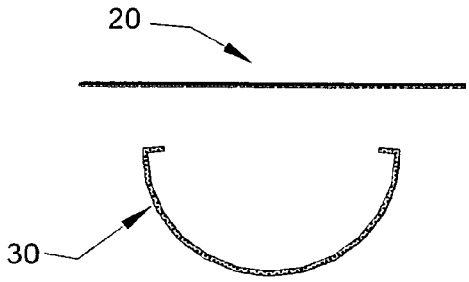
Figure 10A: Flat Non-Pleated Screen Element Positioned over Trough for Insertion
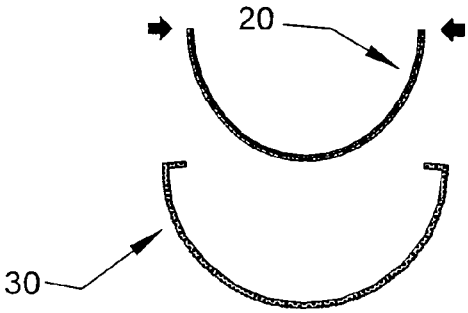
Figure 10B: Flat Non-Pleated Screen Element Formed by Hand Pressure prior to Insertion

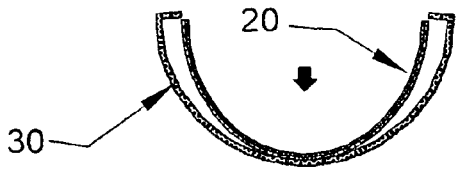
Figure 10C: Flat Non-Pleated Screen Element Inserted into Trough
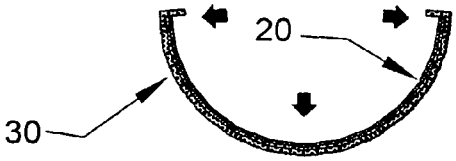
Figure 10D: Screen Element Form Fits to Trough Geometry due to Screen Element Resiliency
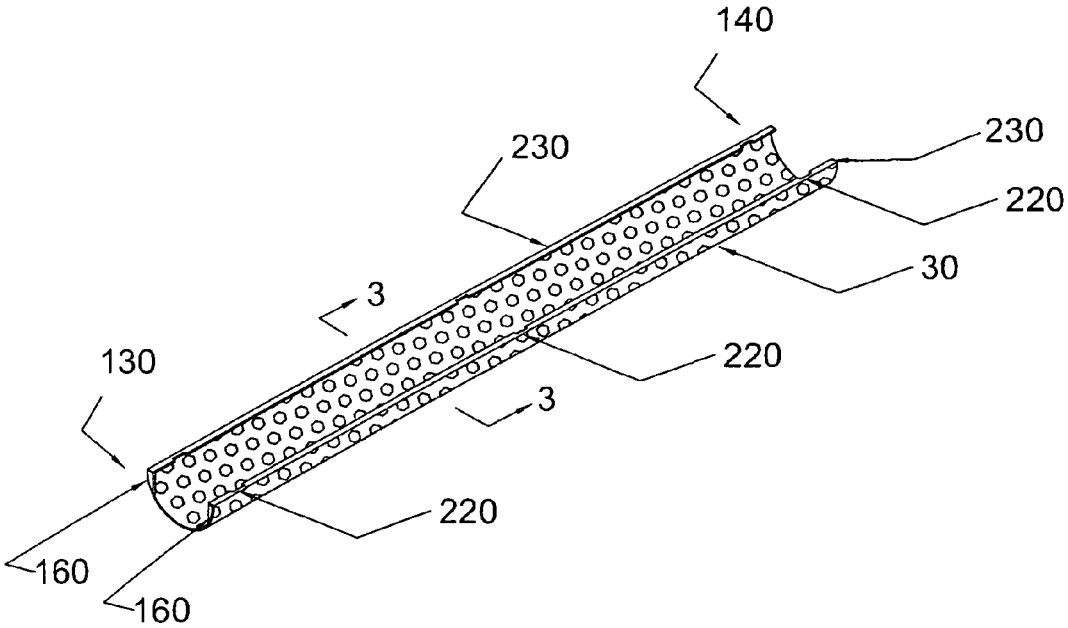
Figure 11: Trough Design for Screen Retention and Extraction

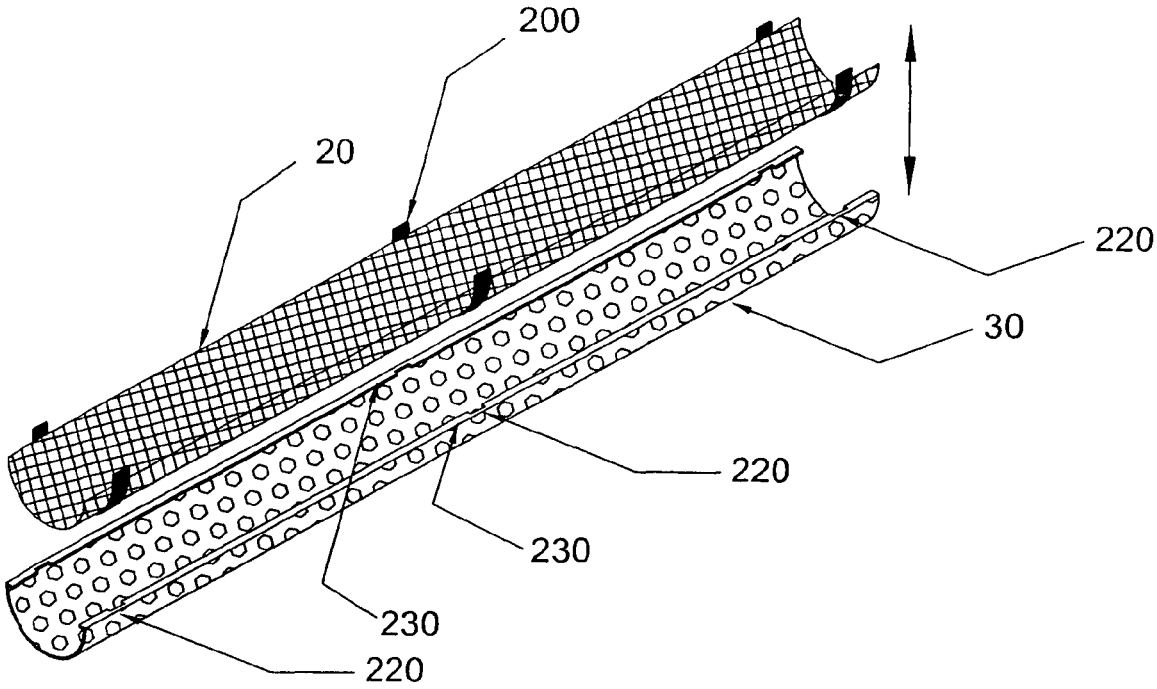
Figure 12: Alternative Screen Element Retention and Extraction Method

SCREEN ASSEMBLIES UTILIZING SCREEN ELEMENTS RETAINED IN PERFORATED TROUGHS

CROSS REFERENCE TO RELATED APPLICATION

This application is a continuation application based on U.S. Ser. No. 10/922,342 filed on Aug. 20, 2004 now abandoned entitled "Screen Assemblies Utilizing Screen Elements Retained in Perforated Troughs".

BACKGROUND OF THE INVENTION

1. Field of Invention

The field of the present invention is screen assemblies used in vibratory separators.

2. Background

Vibratory screen separators with replaceable screen assemblies have long been known which include a base, a resiliently mounted housing, a vibratory drive connected to the housing, and screen assemblies positioned on the housing. The screen assemblies are periodically replaced when process conditions dictate or when the performance of the screening media degrades due to abrasion, failure, or blinding. The screening media can be flat or pleated, single or multi-layer, laminated or un-laminated. Screen assemblies consist of screening media bonded to components structural in nature that are used to fasten or tension the screening media to a vibratory separator so that the motion of the separator is imparted to the screening media.

Flexible rectangular screen assemblies constructed by using structural components that form a "J" or similar shape on two sides of screen are known as hookstrip style screens. Hookstrip style screens are fastened to vibratory separators by pulling the screen assembly taut over a crowned deck. The crown or radius in the deck is necessary because the geometry of the crown keeps the flexible screen in contact with the vibrating deck without approaching tension levels that would damage the screening media.

Screen assemblies constructed by bonding screening media to rectangular structural frames that minimize the flexibility of the screen assembly are known as panel style screens. The structural frame may or may not have internal supporting cross members. Panel style screens are fastened to vibratory separators by clamping one or more surfaces of the structural frame to a mating surface (or deck) of the vibratory separator. The decks of vibratory separators that accept panel screens are noticeably less crowned than the decks of vibratory separators that accept hookstrip style screens, but the decks are usually slightly crowned to prevent panel style screens from flexing or chattering when the vibratory separator is in motion.

SUMMARY OF THE INVENTION

The present invention is directed to screen assemblies for vibratory separators including a structural frame that is mounted in a vibratory separator into which a plurality of lightweight and flexible screen elements are inserted into multiple rows of perforated troughs. The perforated troughs are bonded to each other and to the structural frame. The perforated troughs are aligned parallel to the direction in which solids are conveyed by the vibratory motion. The perforated troughs are assembled to the structural frame so that unscreened material cannot bypass the screening media. The cross sectional geometry of the perforated trough and of the formed screen elements can be rectangular, triangular, half-circular, half-ellipsoid, catenary, hyperbola, or other similar geometric shape. The screen elements include one or more layers of screening media that may be bonded to each other and may be preformed to conform to the geometry of the perforated trough.

The present invention substantially increases the available area for screening compared to the available area when a screen assembly creates a flat or crowned screening surface on a vibratory separator. The ease of replacing individual screen elements in the present invention saves time and material by eliminating the periodic replacement of heavy and cumbersome screen assemblies in vibratory separators. In addition, when the present invention is used to replace hookstrip style screens with crowned screening surfaces, the effective screening area is increased by channeling the flow of unscreened material and preventing the pooling of liquid on either side of a crown deck. In addition, the present invention facilitates storage and shipping of replacement screens because small lightweight screen elements are stored and shipped rather than screen assemblies. The present invention minimizes the environmental impact by minimizing or eliminating the waste presently generated from disposal of screen assemblies. The screen elements of the present invention are easily recycled as the screen elements may have only stainless steel metallic components. The present invention improves the safety and speed with which screen elements can be replaced because small lightweight screen elements are pressed into place as opposed to handling cumbersome and heavy screen frames. The present invention improves the economics of vibratory screening by allowing the replacement of individual screen elements rather than replacing the entire screen assembly in the event of a localized screen failure.

In a first aspect of the present invention, the geometry of the curve that forms the cross section of the perforated trough and the screen element is selected to optimize the surface area available for screening and match the characteristics of the screening media to form fit. A semi-circular cross section is preferred although other cross sections may be used.

In a second aspect to the present invention, the perforation pattern of the trough is selected to maximize the non-blanked area (area available for screening) and optimize the strength and rigidity of the trough.

In a third aspect of the present invention, a screen retention mechanism prevents the movement of screen element within the trough and minimizes any motion dampening effects from looseness of the screen element within the perforated trough.

In a fourth aspect of the present invention, the design of the screen element is determined by the desired screening process. The screen element must be resilient so that it can be slightly compressed for insertion into the trough either through the top opening of the trough or the end opening of the trough. The screen element may be a single layer of screening media or constructed of multiple layers of screening media. Multiple layer construction using two or three layers of screening media is preferable.

In a fifth aspect to the present invention, the cross sectional size of both the perforated trough and the screen element may taper along the length so that movement during the installation of the screen elements or the vibratory motion of the separator will "wedge" the screen element in to the trough to keep the screening media in contact with the supporting trough.

In a further separate aspect of the present invention, the perforated troughs will be attached to a structural frame constructed of stainless steel or another corrosion resistant material that can be installed in existing vibratory screeners for long periods of time or permanently.

Because the screen elements are smaller, lighter and easier to install or change than the screen elements used on prior art vibrating screeners, operators may handle these with greater safety from injury.

The screen elements are easily recycled in cases where the elements can be constructed primarily of stainless steel and non metallic adhesives.

DESCRIPTION OF THE DRAWINGS

For a further understanding of the nature and objects of the present invention, reference should be had to the following drawings in which like parts are given like reference numerals and wherein:

FIG. 1 is a screen assembly constructed of multiple "U" shaped perforated troughs for use on vibratory separators that accept Panel Style Screens;

FIG. 2 is a screen assembly constructed of multiple "U" shaped perforated troughs for use on vibratory separators that accept Hookstrip Style Screens;

FIG. 3 is a cross section of a perforated trough taken along section lines 3-3 of FIG. 11;

FIG. 4A is a side view of a vibratory separator with screen assembly constructed of multiple "U" shaped perforated troughs;

FIG. 4B is an end view of a vibratory separator with screen assembly constructed of multiple "U" shaped perforated troughs;

FIG. 5A is a side view of a formed non-pleated screen element;

FIG. 5B is a cross-sectional view of the screen element of FIG. 5A taken along section lines 5-5 of FIG. 5A;

FIG. 6A is a side view of a formed pleated screen element;

FIG. 6B is a cross-sectional view of the screen element of FIG. 6A taken along section lines 6-6 of FIG. 6A;

FIGS. 7A, 7B and 7C illustrate the method of pre-forming screen elements;

FIG. 8A is a top view of an unformed non-pleated screen element shown partly in cut line;

FIG. 8B is a cross-sectional view of FIG. 8A taken along section lines 8-8 of FIG. 8A;

FIG. 9A is a top view of an unformed pleated screen element shown partly in cut line;

FIG. 9B is a cross-sectional view of FIG. 9A taken along section lines 9-9 of FIG. 9A;

FIGS. 10A, 10B, 10C and 10D illustrate the process of installing screens into the perforated troughs through the top opening of the trough;

FIG. 11 illustrates a method of retaining screen elements within the perforated trough; and FIG. 12 illustrates an alternative method of retaining screen elements within the perforated trough.

DESCRIPTION OF THE PREFERRED EMBODIMENT

FIG. 1 illustrates a screen assembly 1 of a preferred embodiment of the present invention for use on vibratory separators that accept panel style screens. The screen assembly includes a structural frame 10 upon which multiple rows of perforated troughs 30 are mounted. In each perforated trough 30 a screen element (shown in FIGS. 1, 2, 5A, 5B, 6A and 6B) would be inserted for screening. The perforated troughs 30 are constructed by shaping perforated sheet material or wedge wire into the desired cross sectional geometry. It is preferred to have a consistent cross sectional size run the length of the trough 30. In some cases, a tapered cross section size may be required with screen elements of minimal resiliency in order to form fit the screen element to the trough by using axial motion to wedge the screen element in the direction of the taper. The rigidity of the formed perforated troughs 30 is sufficient to minimize the need for cross bracing of the structural frame. The purpose of the structural frame is to (a) impart the motion of the vibrating separator to the perforated troughs with minimal dampening and (b) allow the screen assembly to be gripped or clamped to the deck of the vibratory separator. The purpose of the perforated troughs 30 is primarily to confine, shape, and give support to screening media that is flexible and has openings finer than the openings in the perforated tube.

The direction arrow in FIGS. 1 and 2 is indicative of the direction that the reject or oversize solids (not shown) would be conveyed when the screen assembly 1 is in operation. The diameter or width 40 across the perforated trough 30 can range from ½ inch to 10 inches and the length 50 will be in the range of 12 inches to 60 inches as required to match the design of the vibratory separator. A perforated tube of approximately three-inch width or diameter is preferable because (a) the screen elements are easy to handle, (b) a relatively low number of rows is needed to span most vibratory separators, and (c) the available surface area for screening media is significantly increased in comparison to a flat or crowned surface. In certain applications for coarse screening, the perforated trough 30 could act as a separator without installing screen elements.

FIG. 2 illustrates a screen assembly 2 of a preferred embodiment of the present invention for use on vibratory separators that accept hook style screens. The screen assembly includes a structural component 60 upon which multiple rows of perforated troughs 30 are mounted. In each perforated trough 30, a screen element 20 is inserted. In FIG. 2, the leftmost perforated trough 30 has been drawn as if the screen element has not been inserted so that the perforations in the trough can be seen. The purpose of the structural component 60 is to support the perforated troughs 30 and allow the screen assembly 2 to flex over the crown deck of the vibratory separator. The primary purpose of the perforated tubes is to confine, shape, and support the screening media or screen element 20. The screening media typically has openings finer than the openings in the perforated tube. The direction arrow in FIG. 2 is indicative of the direction that the reject solids (not shown) would be conveyed when the screen assembly 2 is in operation. The diameter or width 40 across the perforated trough 30 can range from ½ inch to 10 inches and the length 50 will be in the range of 12 inches to 60 inches as required to match the design of the vibratory separator.

FIG. 3 is a cross-sectional view of a perforated trough 30 without a screen element 20 installed. Two flat flanges are formed across the top opening of the trough so that the angle 70 defined by lower surface of the flange and the vertical tangent of the trough inner surface is in the range of 80 to 100 degrees. Obtuse angles are preferable because the resiliency of the screen element forces the screen to conform to the inner diameter of the trough as the edge of the screen element slides against the lower flange as it uncoils after insertion into the trough 30.

FIGS. 4A and 4B are a side view and a discharge end view of a vibratory separator with two screen assemblies 1 installed (FIG. 4A). The screen assemblies 1 are on a common plane installed end to end. Unscreened material will enter the feed end 140 of the vibratory separator. Undersized particles and the majority of the carrier fluid will pass through both the screen elements 20 and the perforations in the trough 30 and fall to a sump below (sump not shown). Oversized particles will be retained by the screen elements 20 within the troughs 30 in the screen assembly 1 and be channeled to the discharge end 130 of the vibrating separator. The upwards inclination angle 150 of the screening surface towards the discharge end shown in FIG. 4B is preferred if the vibratory motion is capable of conveying solids uphill. The uphill inclination increases the liquid pool at the feed end of screening surface to take full advantage of the available screening area of the present invention. This does not preclude the use of the present invention on vibratory separators that must operate with flat or slightly downward sloping screening surfaces.

FIGS. 5A and 5B and 6A and 6B illustrate the design of screen elements 20 that have been pre-formed to match the shape of the perforated troughs 30. The screening media can be non-pleated at shown in FIGS. 5A and 5B or pleated as shown in FIGS. 6A and 6B. The discussion below applies to both pleated and non-pleated screen elements 20. Screen elements 20 are constructed using single or multiple layers of screening media. Two or three layers of screening media are preferred. The media 91 with finest opening size is placed on the feed side or inside of the trough shaped element. Any subsequent layers are progressively coarser. The middle layer 90, if used, provides de-blinding characteristics for the screen element by partially occluding the opening in the finest mesh 91 and minimizing the likelihood of near size particles lodging in the openings of the finest screening media. The outermost layer 80 supports the finer layers of screening media and increases the resiliency of the screen element to create the form fitting characteristics of the screen element when inserted in the perforated trough. The edges of the screen elements are closed and sealed to minimize the danger from what otherwise would be the exposed sharp ends of the screening media. The screen element edge 100 parallel to the axis of the trough 30 is not a conveying or screening surface and may be capped by hemming the screening media, or by crimping a sheet metal edge to the screen media, or by impregnating plastic or epoxy into the screening media. The U shaped or short edge 120 will need to be non-obstructive to the conveyance of oversize particles or the flow of fluid. The short edge 120 can be capped by hemming a fold in the screening media to the outside towards the perforated trough 30. Alternatively, the short edge 120 can be sealed by plastic or epoxy impregnation.

As illustrated in FIGS. 7A, 7B, 7C pre-forming screen elements to the trough geometry may need to take place over a press 180 to prevent distortion of some screening media when the screen elements 20 are inserted into the troughs 30. The cross sectional geometry of the male section of the press 180 will be the same shape but of a slightly larger diameter or width than the perforated trough for which the press 180 is intended to make screen elements 20. A female section 185 of the press is used to form the screening media into the desired geometry to provide the resilient form fitting characteristics of the screen elements when inserted into the perforated trough 30. Single or multiple layer screening media can be formed into screen elements 20. When constructing layered screen elements, the finest screening media, such as middle layer 90, is positioned over the male section of the press first with subsequent and coarser layers of screening media, such as screening media 80, following to the outside. A layer 85 of plastic laminate or glue may be used between the finer screening media and a coarser screening media. Capping or impregnation of the screen element edges may also take place while the screening media is formed in the press.

As illustrated in FIGS. 8A and 8B and 9A and 9B unformed screen elements may also be used. FIG. 8 is a non-pleated screen element comprising of one or more layers of screening media, and FIG. 9 is a pleated screen element comprising of one or more layers of screening media. Two layers are shown in both figures for sake of clarity. The finest screening media, such as middle layer 90, will be the innermost layer so that unscreened material passes through the finest screening media first. The other layer 80 will be coarser screening media to add strength and rigidity to the screen element 20. The long edge 100 of the screen element 20 is not a conveying or screening surface and may be capped by hemming the screening media, by a crimped sheet metal edge, or a plastic or epoxy impregnation. The U shaped or short edge 120 will need to be non-obstructive to the flow of oversize particle or carrier fluid and can be capped by hemming or by plastic or epoxy impregnation.

FIGS. 10A, 10B, 10C and 10D illustrate the insertion of an unformed screen element 20 into a perforated trough 30. Starting at the top left, FIG. 10A shows a unformed screen element 20 which is positioned over the top opening of the trough 30; FIG. 10B shows that by use of light hand or fingertip pressure, the element 20 may be flexed to a diameter smaller, than the opening in the trough 30; FIG. 10C shows the screen element 20 being inserted into the trough 30; and FIG. 10D shows the element 20 being released to resiliently fit to the trough 30 inner surface.

FIG. 11 illustrates the screen element 20 retention tab 160 that is permanently bonded to each perforated trough 30 at the outlet of the trough 30 to prevent the screen element (not shown in FIG. 11) from conveying out of the trough 30 due to the vibratory motion. The tab 160 is positioned immediately below the flange 130 on the perforated trough 30 to prevent interference with solids conveyance that takes place on the lower surface of the trough 30. The clip 160 is small enough to not interfere with end loading of the screen elements 20 into the perforated trough 30. FIG. 11 also shows the feed end 140 wherein no tab 160 is required.

FIG. 12 indicates an alternative screen element design wherein thin strips 200 with the characteristics of a leaf spring are bonded to the screening media in preformed screen elements 20. The strips 200 are positioned on the screen element to match notches 220 in the flanges 130 on the perforated troughs 30. The strips 200 serve two purposes by (a) retaining the screen element 20 within the trough 30, and (b) adding resiliency to the screen element 20 to improve the fit between the trough 30 and the screen element 20 after it has been inserted. The notches 220 in the flange 130 on the perforated troughs 30 may be formed on all screen elements 20 to assist in the removal of the screen elements 20.

The present invention is directed to screen assemblies for vibratory separators including a structural frame that is mounted in a vibratory separator into which a plurality of lightweight and flexible screen elements are inserted into multiple rows of perforated troughs. The perforated troughs are bonded to each other and to the structural frame. The perforated troughs are aligned parallel to the direction in which solids are conveyed by the vibratory motion. The perforated troughs are assembled to the structural frame so that unscreened material cannot bypass the screening media. The cross sectional geometry of the perforated trough and of the formed screen elements can be rectangular, triangular, half-circular, half-ellipsoid, catenary, hyperbola, or other similar geometric shape. The screen elements include one or more layers of screening media that may be bonded to each other and may be preformed to conform to the geometry of the perforated trough.

The present invention substantially increases the available area for screening compared to the available area when a screen assembly creates a flat or crowned screening surface on a vibratory separator. The ease of replacing individual screen elements in the present invention saves time and material by eliminating the periodic replacement of heavy and cumbersome screen assemblies in vibratory separators. In addition, when the present invention is used to replace hook-strip style screens with crowned screening surfaces, the effective screening area is increased by channeling the flow of unscreened material and preventing the pooling of liquid on either side of a crown deck. In addition, the present invention facilitates storage and shipping of replacement screens because small lightweight screen elements are stored and shipped rather than screen assemblies. The present invention minimizes the environmental impact by minimizing or eliminating the waste presently generated from disposal of screen assemblies. The screen elements of the present invention are easily recycled as the screen elements may have only stainless steel metallic components. The present invention improves the safety and speed with which screen elements can be replaced because small lightweight screen elements are pressed into place as opposed to handling cumbersome and heavy screen frames. The present invention improves the economics of vibratory screening by allowing the replacement of individual screen elements rather than replacing the entire screen assembly in the event of a localized screen failure.

In a first aspect of the present invention, the geometry of the curve that forms the cross section of the perforated trough and the screen element is selected to optimize the surface area available for screening and match the characteristics of the screening media to form fit. A semi-circular cross section is preferred although other cross sections may be used.

In a second aspect to the present invention, the perforation pattern of the trough is selected to maximize the non-blanked area (area available for screening) and optimize the strength and rigidity of the trough.

In a third aspect of the present invention, a screen retention mechanism prevents the movement of screen element within the trough and minimizes any motion dampening effects from looseness of the screen element within the perforated trough.

In a fourth aspect of the present invention, the design of the screen element is determined by the desired screening process. The screen element must be resilient so that it can be slightly compressed for insertion into the trough either through the top opening of the trough or the end opening of the trough. The screen element may be a single layer of screening media or constructed of multiple layers of screening media. Multiple layer construction using two or three layers of screening media is preferable.

In a fifth aspect to the present invention, the cross sectional size of both the perforated trough and the screen element may taper along the length so that movement during the installation of the screen elements or the vibratory motion of the separator will "wedge" the screen element in to the trough to keep the screening media in contact with the supporting trough.

In a further separate aspect of the present invention, the perforated troughs will be attached to a structural frame constructed of stainless steel or another corrosion resistant material that can be installed in existing vibratory screeners for long periods of time or permanently.

Because many varying and different embodiments may be made within the scope of the invention concept taught herein which may involve many modifications in the embodiments herein detailed in accordance with the descriptive requirements of the law, it is to be understood that the details herein are to be interpreted as illustrative and not in a limiting sense.

What is claimed is:

1. A screen assembly for use with a vibratory separator to screen material and convey solids, comprising:

a holder frame mounted in the vibratory separator;

a set of mechanically formed replaceable screen elements with each of said screen elements having a length and two edges that are continuous along said screen element length; and a set of screen guides;

wherein each of said screen guides comprising a perforated trough having a length and a top opening with flanges on each side of said top opening that are continuous along said screen guide length, and said trough supporting one of said screen elements, wherein said screen guides being bonded to said frame, wherein each of said flanges being in continuous contact with one of said edges of said supported screen element and retaining said screen element in said trough;

wherein said troughs are aligned parallel to the direction of the conveyance of the solids; and wherein said screen elements being removably attached to said perforated screen guides.

2. The screen assembly of claim 1, wherein each of said screen elements having a top side and a bottom side, and wherein said bottom side of each screen element is in contact with one of said troughs.

3. The screen assembly of claim 2, wherein each of said troughs having an output end having two tabs and an input end, wherein each of said screen elements having two ends, wherein one of said ends of each of said screen elements is in contact with said tabs on one of said troughs and retained on said trough by said tabs, and wherein said tabs are configured to allow movement of said screen element through said output end of said trough for positioning with said trough.

4. The screen assembly of claim 3, wherein said flanges are substantially horizontal.

5. The screen assembly of claim 3, wherein said flanges having a lower surface and said troughs having an inner surface, and wherein an angle between said flange lower surface and a vertical tangent of said trough inner surface is between 80 and 100 degrees.

6. The screen assembly of claim 4, wherein said perforated troughs having 70% to 90% open area.

7. The screen assembly of claim 4, wherein said screen elements preformed to conform to the geometry of said troughs.

8. The screen assembly of claim 4, wherein said flanges having a plurality of notches for receipt of a screen element.

9. The screen assembly of claim 8, wherein each of said screen elements having a plurality of strips bonded to them, and wherein said strips positioned through said notches.

10. The screen assembly of claim 9, wherein said strips configured to block outward movement of the screen element retained in the trough.

11. A frame assembly for use with a vibratory separator to screen material and convey solids, comprising:

a frame, wherein said frame attached in the vibratory separator;

a set of screening elements; and a set of screen guides, wherein each of said guides comprising a perforated trough and being bonded to said frame and having an output end having two tabs and an input end;

wherein each of said troughs having a length and a top opening with flanges on each side of said top opening that are two continuous along said trough length;

wherein each of said screening elements having a top side, a bottom side and two ends;

wherein said bottom side of each screening element being in contact with one of said troughs;

wherein said flanges of each of said troughs retaining one of said screening elements; and wherein each one of said screening elements being slidingly mounted on one of said screen guides with one of said screening element ends being in contact with said tabs and retained on said guide by said tabs.

12. The frame assembly of claim 11, wherein each of said screening elements having a length and two edges that are continuous along said length; and wherein each of said flanges is in continuous contact with one of said edges.

13. The frame assembly of claim 12, wherein said tabs are configured to allow movement of said retained screen element through said output end of said trough for positioning with said trough.

14. The frame assembly of claim 13, wherein said flanges are substantially horizontal.

15. The frame assembly of claim 13, wherein said flanges having a lower surface and said troughs having an inner surface, and wherein an angle between said flange lower surface and a vertical tangent of said trough inner surface is between 80 and 100 degrees.

16. The frame assembly of claim 14, wherein each of said perforated troughs having 70% to 90% open area.

17. The frame assembly of claim 14, wherein said flanges having a plurality of notches for receipt of a screening element.

18. The frame assembly of claim 17, wherein said screening elements having a plurality of strips bonded to them, and wherein said strips positioned through said notches and configured to retain said screen elements within said guides.

19. The frame assembly of claim 14, wherein said troughs having a diameter, and said trough diameter in a range from one-half inch to ten inches.

20. The frame assembly of claim 19, wherein said troughs having a length, and said length in a range from twelve inches to sixty inches.

* * * * *